US012601479B2

(12) United States Patent
Wiesenberg

(10) Patent No.: US 12,601,479 B2
(45) Date of Patent: Apr. 14, 2026

(54) PROCESS AND BURNER FOR THE THERMAL DISPOSAL OF POLLUTANTS IN PROCESS GASES

(71) Applicant: DAS Environmental Expert GmbH, Dresden (DE)

(72) Inventor: Ralph Wiesenberg, Dresden (DE)

(73) Assignee: DAS Environmental Expert GmbH, Dresden (DE)

( * ) Notice: Subject to any disclaimer, the term of this patent is extended or adjusted under 35 U.S.C. 154(b) by 681 days.

(21) Appl. No.: 17/792,168

(22) PCT Filed: Jan. 17, 2022

(86) PCT No.: PCT/EP2022/050860
§ 371 (c)(1),
(2) Date: Jul. 12, 2022

(87) PCT Pub. No.: WO2022/171383
PCT Pub. Date: Aug. 18, 2022

(65) Prior Publication Data

US 2023/0139785 A1 May 4, 2023

(30) Foreign Application Priority Data

Feb. 12, 2021 (DE) ..... 102021103365.9

(51) Int. Cl.
*F23G 7/06* (2006.01)
*F23D 14/22* (2006.01)
(Continued)

(52) U.S. Cl.
CPC ..... *F23G 7/065* (2013.01); *F23D 14/22* (2013.01); *F23D 14/68* (2013.01); *F23L 7/007* (2013.01);
(Continued)

(58) Field of Classification Search
None
See application file for complete search history.

(56) References Cited

U.S. PATENT DOCUMENTS 4,555,389 A 11/1985 Soneta et al.
5,527,984 A * 6/1996 Stultz ..... F23G 7/065 423/220
(Continued)

FOREIGN PATENT DOCUMENTS

CN 88101392 A 10/1988
CN 102644928 B 8/2012
(Continued)

*Primary Examiner* — Jason Lau
(74) *Attorney, Agent, or Firm* — Rogowski Law LLC

(57) ABSTRACT

The invention relates to a method for the thermal disposal of pollutants in industrial gases, wherein, in order to generate a flame for burning the pollutants, a fuel gas and oxygen are fed into a combustion chamber (19) of a burner (1), where they are then ignited, wherein a diluent gas is fed in in order to reduce the calorific value of the gas mixture relative to the fuel gas, while the throughput of the diluent gas is regulated as a function of the composition of the industrial gas in order to adapt the gas mixture consisting of diluent gas and fuel gas. The invention also relates to a burner (1) for generating a flame (2) in a combustion chamber (19) for burning pollutants in an industrial gas, and to a waste-gas treatment device having at least one burner (1) arranged in a combustion chamber (19).

16 Claims, 3 Drawing Sheets

(51) Int. Cl.

| | |
|---|---|
| ***F23D 14/68*** | (2006.01) |
| ***F23L 7/00*** | (2006.01) |
| ***F23N 1/04*** | (2006.01) |
| ***F23N 5/00*** | (2006.01) |

(52) U.S. Cl.
CPC ..... *F23N 1/042* (2013.01); *F23N 5/003* (2013.01); *F23G 2209/142* (2013.01); *F23K 2400/10* (2020.05)

(56) References Cited

U.S. PATENT DOCUMENTS

| | | | | |
|---|---|---|---|---|
| 6,153,150 | A | 11/2000 | Moore | |
| 7,074,034 | B2 | 7/2006 | Hoke, Jr. | |
| 7,690,204 | B2 | 4/2010 | Drnevich | |
| 8,925,272 | B1 * | 1/2015 | Amatruda | E04D 1/2963 52/557 |
| 9,956,525 | B2 | 5/2018 | Kim et al. | |
| 2005/0064353 | A1 | 3/2005 | Wiesenberg et al. | |
| 2005/0172616 | A1 | 8/2005 | Reichardt | |
| 2008/0095675 | A1 | 4/2008 | Hartung | |
| 2009/0029300 | A1 * | 1/2009 | Ponzi | F23D 14/10 431/12 |
| 2010/0275825 | A1 * | 11/2010 | Bool, III | F23K 1/00 110/297 |
| 2016/0376719 | A1 * | 12/2016 | Powell, IV | C25C 3/12 205/377 |
| 2017/0065934 | A1 | 3/2017 | Kim et al. | |
| 2018/0058687 | A1 * | 3/2018 | Hellewell | F23L 9/02 |
| 2020/0408404 | A1 | 12/2020 | Wiesenberg | |

FOREIGN PATENT DOCUMENTS

| | | | |
|---|---|---|---|
| CN | 107420922 | A | 12/2017 |
| CN | 109974463 | A | 7/2019 |
| CN | 112146108 | A | 12/2020 |
| EP | 0285485 | A1 | 10/1988 |
| EP | 0311317 | A2 | 4/1989 |
| EP | 0346893 | B1 | 12/1989 |
| GB | 2579197 | A | 6/2020 |
| JP | 2007090276 | A | 4/2007 |
| JP | 2013193069 | A | 9/2013 |
| JP | 2017089985 | A | 5/2017 |
| KR | 20120021651 | A | 3/2012 |
| KR | 101174284 | B | 8/2012 |
| KR | 101275475 | B | 6/2013 |
| KR | 101405166 | B1 | 6/2014 |
| KR | 20150139665 | A | 12/2015 |
| KR | 101600522 | B | 3/2016 |
| TW | 458803 | B | 10/2001 |
| TW | I271491 | B | 1/2007 |
| WO | 2012140415 | A1 | 10/2012 |
| WO | 2020104804 | A1 | 5/2020 |

* cited by examiner

PROCESS AND BURNER FOR THE THERMAL DISPOSAL OF POLLUTANTS IN PROCESS GASES

CROSS-REFERENCE TO RELATED APPLICATIONS

This application is a national stage application (under 35 USC § 371) of PCT/EP2022/050860, filed Jan. 17, 2022, which claims benefit of DE 102021103356.9, filed Feb. 12, 2021, the contents of each of which is incorporated by reference herein.

BACKGROUND OF THE INVENTION

Technical Field and State of the Art

The invention relates to a method for thermally disposing of pollutants in industrial gases. The invention also relates to a burner for generating a flame in a combustion chamber for burning pollutants in an industrial gas and to a waste-gas treatment device having at least one burner arranged in a combustion chamber.

In many industrial process installations for processing semiconductor materials or for the production of photovoltaic cells, gases are used for layer deposition and for etching. Reactive and environmentally hazardous industrial gases and their reaction products formed in the process are often treated employing local waste disposal systems close to the process installation. Such toxic gases are also formed in large amounts, for example, during the production of semiconductor switching circuits and, due to their toxicity, cannot be discharged into the environment in untreated form.

The invention serves to treat not only industrial gases of such chemical vapor deposition (CVD) processes or dry etching processes, but also pollutant-laden waste gases stemming from other processes. Examples of such toxic or environmentally hazardous gases are $SiH_4$, $SiH_2Cl_2$, $SiF_4$, $NH_3$, $PH_3$, $BCl_3$, $SF_6$ or $NF_3$.

The growing demand for substrates modified in this manner gives rise to a corresponding increase in the share of industrial gases that have to undergo treatment in order to ensure compatibility with environmental and health stipulations.

A common method for such a purpose is disposal through the modality of combustion and subsequent scrubbing with a scrubbing liquid. A known approach consists of arranging a burner in the lid of a combustion reactor and feeding the noxious gases through several pipes that open up in the vicinity of the flame.

The reaction products of the thermal treatment are present in either gaseous or solid form. After the water-soluble gases and the solid particles have been washed out, the remaining gaseous reaction products such as water vapor or $CO_2$ can be released into the atmosphere without having to undergo additional treatment.

It goes without saying that numerous combustion methods and reaction chambers have already been developed and employed in actual practice for the thermal reaction. For instance, European patent EP 0 346 893 B1 discloses an arrangement for cleaning waste gases, consisting of a reaction chamber where a burner is installed underneath which, on the one hand, is operated with fuel gases such as hydrogen and oxygen and to which, on the other hand, the waste gas that is to be cleaned is then fed. The reaction product formed during the combustion contains solid components as well as water-soluble reaction products.

Korean patent specification KR 101 275 475 B and Chinese examined application CN 102 644 928 B disclose a thermal treatment device for waste gases containing harmful substances. These substances are converted into other compounds. The thermal treatment device has a combustion chamber, one or more burners, one or more waste-gas inlet openings and one waste-gas outlet opening.

German patent application DE 10 342 692 A1 discloses a device having a combustion chamber on which there is at least one burner situated on a lid arranged on the top, so that a flame is directed into the interior of the combustion chamber from the top to the bottom. Likewise present is a feed for a scrubbing liquid with which a contiguous film can be formed on the entire inner lateral surface of the combustion chamber.

German patent application DE 10 2004 047440 A1 discloses a reactor chamber with an outer and an inner wall, whereby the inner wall tapers downwards in the shape of a funnel at a prescribed angle and, on the reactor chamber, there is an apparatus which seals off the reactor chamber towards the top and which serves to thermally treat toxic gases. The inner wall of the reactor chamber has on the inside a water film that flows uniformly downwards.

Japanese published unexamined patent application JP 2017 089985 A discloses a waste-gas treatment device for the thermal treatment of a waste gas, having a combustion chamber for burning the waste gas. An ignition apparatus has an air-fuel premixing chamber and a spark plug for generating an ignition flame.

U.S. pat. appln. no. 2017 065 934 A1 and U.S. granted U.S. Pat. No. 9,956,525 B2 disclose a device for cleaning waste gases for an integrated semiconductor, having a lid with a burner mounted thereon for purposes of generating a flame, and having a plurality of waste-gas inlet pipes. A water curtain prevents the accumulation of byproducts in the device.

Since high temperatures are needed for the disposal of the stable perfluorinated substances used in these processes such as, for example, tetrafluoromethane ($CF_4$), hexafluoroethane ($C_2F_6$) or sulfur hexafluoride ($SF_6$), as a rule, combustion with natural gas or methane as the fuel gas and oxygen as the oxidant is used for this purpose. These perfluorinated compounds cannot be disposed of with sufficient efficiency by means of combustion employing a flame that utilizes natural gas as the fuel gas and air as the oxidant. For this reason, combustion with oxygen as the oxidant is deployed for this purpose.

Even though combustion with oxygen reaches high temperatures, thermal nitrogen oxide ($NO_x$) is always formed in this process. The requisite combustion temperature and, under certain circumstances, also the optimal stoichiometry of the flame, are dependent on the industrial gases in question.

PCT international application WO 2020/104804 A1 discloses a method based on the combustion of natural gas with air, whereby fuel gas is admixed into the noxious gas and oxygen is added in the vicinity of the noxious gas. Moreover, this document proposes the use of argon or carbon dioxide as a diluent gas.

Alternative technologies according to Korean patent specification KR 101 174 284 B, Korean patent specification KR 101 405 166 B1, Korean unexamined patent application 2012 0021 651 A, PCT international application WO 2012 140 425 A1, Japanese published unexamined patent application JP 2013 193 069

(A), Korean unexamined patent application 2015 0139 665 A and Korean patent specification KR 101 600 522 B are based on plasma, for instance, arc plasma or microwave plasma. Catalytic methods disclosed, for example, in Japanese published unexamined patent application JP 2007 090 276 A, have not been able to become well established in this field of application due to the many impurities.

Since semiconductor manufacture makes use of many different industrial gases and the composition of the gas can also change in the course of a process, it can happen that the combustion temperature actually needed for the disposal of a waste gas falls below the combustion temperature in the burner, as a result of which thermal nitrogen oxide is unnecessarily formed. Since nitrogen oxides are harmful to the environment or to health, their emissions should be kept as low as possible and they are often subject to statutory limit values.

Before the backdrop of the above-mentioned drawbacks, the invention is based on an objective of putting forward a method and a burner which allow the disposal of a wide array of gas mixtures under optimal conditions, especially with which the formation of thermal nitrogen oxide is suppressed as much as possible while also ensuring the conversion of the gases that are to be disposed of.

SUMMARY OF THE INVENTION

The invention relates to a method for the thermal disposal of pollutants in industrial gases, wherein, in order to generate a flame for burning the pollutants, a fuel gas and oxygen are fed into a combustion chamber of a burner, where they are then ignited.

A diluent gas, for example, an inert gas, especially nitrogen, is fed in in order to reduce the calorific value of the gas mixture relative to the fuel gas, while the throughput of the diluent gas is regulated as a function of the composition of the industrial gas in order to adapt the gas mixture consisting of diluent gas and fuel gas.

In particular, the throughput of the diluent gas can be regulated as a function of the composition of the industrial gas stemming from the incoming gas streams of various upstream processes, for instance, chemical vapor deposition (CVD) or dry etching processes. This set of information about the incoming gas streams could be about, for example, which of the processing chambers of the upstream processes are active, or about which process the appertaining processing chamber carries out.

The nitrogen oxide ($NO_x$) emission during the disposal of perfluorinated compounds (PFCs) without a reactive share of nitrogen, that is to say, essentially all of the PFCs except for $NF_3$, stems primarily from the formation of thermal $NO_x$. In the burners used in this context involving the mixture of fuel gas and oxygen in the exit area of the burner, temperatures peaks as a rule only prevail within a small mixing zone of the flame in this process. In contrast, $NO_x$ formation is considerably less in the case of burners with natural gas and air due to the lower peak temperatures involved.

For this reason, according to the invention, in order to lower or reduce the calorific value of the gas mixture relative to the calorific value of the pure fuel gas, the diluent gas is admixed for purposes of lowering the peak temperatures in the hottest burning zone in that the fuel gas is diluted.

The method involves the combustion of the industrial waste gas that is to be disposed of by utilizing the flame generated by the burner, wherein a regulated stream of the diluent gas, for instance, nitrogen, is mixed into the fuel gas as a function of the composition of the industrial waste gas that is to be treated.

Owing to the method according to the invention, the formation of $NO_x$ is markedly reduced while the efficiency of the disposal procedure is nevertheless ensured.

The method also allows a dynamic adaptation to the various gas compositions that are to be disposed of, thanks to a regulation of the gas streams into or inside the burner. This is done by influencing the composition of the fuel gas, especially by admixing the diluent gas, for example, nitrogen or other inert gases, into the fuel gas in a regulated manner.

The admixture of nitrogen into the fuel gas slows down the combustion reaction, so that lower maximum temperatures are reached in the hottest zone of the flame of the burner. Since the formation of thermal $NO_x$ is determined by these maximum temperatures, less $NO_x$ is consequently formed.

Experiments, however, have shown that, during the disposal of $CF_4$, the degradation of $CF_4$ is likewise determined by the maximum temperature reached in the industrial waste gas.

The disposal of other substances that are to be disposed of is influenced to a considerably lesser degree by the maximum temperature in the flame. The admixture of the diluent gas, however, not only lowers the temperature but also augments the extension of the flame. This brings about a stronger mixing of the industrial gas with the flame and leads to a more pronounced reaction of the pollutants. For this reason, when it comes to the disposal of other stable fluorinated substances such as, for instance, sulfur hexafluoride ($SF_6$) and hexafluoroethane ($C_2F_6$), it is possible to lower the flame temperature somewhat, without impairing the disposal efficiency, but with a markedly reduced formation of thermal NO.

However, excessive dilution of the fuel gas or also of the oxygen, in turn, would also hinder the destruction of these fluorinated substances. Therefore, disposal of sulfur hexafluoride ($SF_6$) by means of combustion with natural gas as the fuel gas is not possible if only air is employed as the oxidant. Experiments have shown that the use of a flame of natural gas with diluted oxygen or with oxygen-enriched air is not equally advantageous as the use of methane or natural gas enriched with nitrogen.

According to a first advantageous embodiment of the invention, it is provided for the diluent gas to be admixed to the fuel gas before introduction into the combustion chamber. In particular, it can be provided for the admixture of the diluent gas to the fuel gas to take place before the generation of a flame for the combustion of the pollutants and/or before the fuel gas is mixed with the oxygen.

The method can especially be employed for diffusion burners. In this context, it is advantageous if the fuel gas or the diluted fuel gas is fed into the combustion chamber or into the pre-mixing chamber separately from the oxygen and if both gas streams are only combined immediately prior to the reaction. This causes the diluted fuel gas to reach the still undiluted oxygen in the reaction zone. Consequently, no fuel-rich reaction zone can form at the interface between the diluted fuel gas and the undiluted oxygen. Otherwise, fuel-gas rich zones would be formed at an interface between the diluted oxygen and the undiluted fuel gas. However, so-called "prompt $NO_x$" can be formed in such fuel-gas rich areas. In other words, the dilution of the fuel gas not only lowers the peak temperature and thereby reduces thermal $NO_x$ formation but also diminishes the formation of prompt $NO_x$.

When it comes to a burner with separate feeds for the fuel gas and for the oxygen, the diluent gas also serves to influence the relative velocity and volumes of both gas streams and thus also the mixing behavior. When methane is used as the fuel gas, the stoichiometric ratio to oxygen is 1:2. The admixture of diluent gas into the fuel gas renders the volumes of both gas streams more similar each other. The exiting velocities become the same, so that less turbulence occurs in the mixing zone and the combustion transpires more slowly.

The diluent gas can advantageously be an inert gas, for instance, nitrogen.

According to another advantageous embodiment of the invention, the volume of oxygen and/or of fuel gas flowing into the combustion chamber and/or the volume of diluent gas admixed to the fuel gas is/are regulated separately. This allows dynamic adaptation to the various gas compositions that are to be disposed of.

According to an advantageous refinement of the invention, it is provided for the information, that is to say, signals, about the composition of the industrial gas to be relayed to a regulating means of the gas throughput for the fuel gas, for the oxygen and/or for the diluent gas, so that, on the basis of this information, the fuel gas composition is dynamically adapted by regulating the gas throughput. In particular, this information about the composition of the industrial gas can be ascertained from the operating states of a process such as, for instance, a CVD or dry etching, that has preceded the method for thermally disposing of pollutants in industrial gases.

Conceivably, a unit interconnected between the preceding working process and the combustion process can provide information about the composition of the industrial gas that can then be used to regulate the gas throughput. Therefore, specific, sensitive information about the preceding process can be processed and filtered in this interconnected unit and can be summarized into aggregated information about the industrial gas.

For example, if the industrial waste gas contains $CF_4$, then the feed of diluent gas such as, for instance, the stream of nitrogen into the fuel gas, can be markedly reduced.

If the industrial waste gas does not contain $CF_4$, then a stream of the diluent gas, e.g. a nitrogen stream calculated by the regulation or control means of the installation, can be added.

The feed of diluent gas can be calculated on the basis of prescribed empirically ascertained parameters and on the basis of information obtained from the signals.

The fuel gas stream through the burner can likewise be regulated on the basis of information or signals from the upstream processes. These signals can provide information about the momentary stream of inert gases, especially $N_2$, that are contained in the industrial waste gas.

The stream of oxygen through the burner can be regulated in the form of a prescribed ratio relative to the fuel gas. The ratio of oxygen flow to the fuel gas flow can be selected as a function of signals that provide information about the composition of the industrial waste gas.

According to an advantageous refinement of the invention, if the industrial gas contains tetrafluoromethane ($CF_4$), the feed of the diluent gas is reduced, especially all the way to below a value that is or can be prescribed.

This value can be selected in such a way that, if the industrial gas contains tetrafluoromethane ($CF_4$), the inflow of diluent gas amounts to a maximum of 1% of the volumetric flow of the fuel gas.

If the industrial gas does not contain any pollutants that harm the climate, especially perfluorinated carbon compounds such as tetrafluoromethane ($CF_4$), hexafluoroethane ($C_2F_6$) and/or sulfur hexafluoride ($SF_6$), then the diluent gas can be fed into the fuel gas in a regulated manner, even well above a value of 1% of the volumetric flow of the fuel gas. The stream of the diluent gas can also amount to more than 100% of the volumetric flow of the fuel gas.

According to another advantageous embodiment of the invention, an additional oxidant such as, for instance, air or oxygen, can be fed in a regulated manner into the combustion chamber as a function of the chemical composition of the industrial gas.

Even though the burner allows the ratio of fuel gas to oxygen to be varied, for certain processes, it might be necessary for an oxidant such as, for example, air or oxygen, or else for a reducing agent such as a fuel gas, to be additionally fed into the reactor physically separately from the burner.

For the treatment of waste gas mixtures stemming from upstream processes that involve large amounts of combustible gases, an additional stream of an oxidant such as, for example, air or oxygen, can be fed to the combustion reactor.

Even though this stream is not conveyed through the burner, it does have an impact on the formation of nitrogen oxide as well. For this reason, in order to minimize nitrogen oxide formation, it is advantageous to also utilize information or signals from the upstream processes which indicate the demand for additional oxidant in the reactor, so that, when dealing with variable waste gas mixtures, it is always the case that only the requisite amount of additional oxidant is fed in.

Analogously to this, when it comes to the treatment of waste gas mixtures that contain large amounts of oxidizing gases such as, for instance, oxygen, fluorine or even $N_2O$, a reducing agent can be fed in physically separately from the burner. This reducing agent can be, for example, fuel gas or even hydrogen.

An independent idea of the invention relates to a burner for generating a flame in a combustion chamber for burning pollutants in an industrial gas, having a feed line for a fuel gas and having a feed line for oxygen, each to be fed into the combustion chamber, and having an ignition apparatus for igniting the gas mixture present in the combustion chamber.

According to the invention, another feed line is provided for admixing a diluent gas, preferably an inert gas, e.g. nitrogen, into the fuel gas, wherein the additional feed line for the diluent gas opens up in the feed line for the fuel gas.

The ignition apparatus can be an apparatus to generate a spark, or else a hot surface in the burner. An additional ignition burner on the combustion chamber, however, is likewise conceivable.

According to a first advantageous embodiment of the burner according to the invention, the throughput of the diluent gas in the additional feed line can be regulated as a function of the composition of the industrial gas that is to be treated in order to attain a dynamic adaptation of the gas composition, and this is done by means of a regulation means associated with the additional feed line.

According to another embodiment of the burner, the feed lines each have a regulation means and/or a blocking means for regulating and/or blocking the appertaining gas throughput.

According to another independent idea of the invention, a waste-gas treatment device is provided, having at least one burner arranged in a combustion chamber, for purposes of generating a flame to burn pollutants in an industrial gas, having at least one feeding means for the industrial gas, and having at least one discharge means for the thermally treated waste gases.

At least one feed line can be provided for a reaction gas, especially an oxidant and/or a reducing agent.

According to an advantageous variant, liquid feed lines can be provided, especially on the side wall of the combustion chamber, so that, on the one hand, due to the feed of a liquid, there is protection against corrosion or formation of deposits on the side wall and, on the other hand, the wall is cooled off.

A small collar can be installed on the side wall upstream from the liquid feeding lines in order to protect the noxious gas inlets against liquid splashing. The lid of the reactor can be configured so as to be double walled for purposes of attaining better heat insultation. An elevated surface temperature on the inside of the lid reduces the probability of adhesion of solids. For purposes of displacing particles, a flushing gas, for example, nitrogen, can be fed in via the double-walled lid, said gas being flushed in through porous sintering elements located at the ends of the noxious gas feed sites.

In an advantageous manner, regulation means can be provided that serve to regulate and/or control the throughput through the feed lines for the fuel gas and/or for the oxygen and/or for the diluent gas.

In particular, the waste-gas treatment device can be provided with a control unit that is connected to the regulation means for regulating and/or controlling the throughput through the feed lines for the fuel gas and/or for the oxygen and/or for the diluent gas. This control unit can have a communication connection through which information about the operating state of upstream process installations can be received.

Additional objectives, advantages, features and application possibilities of the present invention can be gleaned from the description below of an embodiment making reference to the drawings. In this context, all of the described and/or depicted features, either on their own or in any meaningful combination, constitute the subject matter of the present invention, also irrespective of their compilation in the claims or in the claims to which they refer back.

DESCRIPTION OF THE DRAWINGS

The In this context, the following is shown, at times schematically.

For the sake of clarity, identical components or those having the same effect are provided with the same reference numerals in the figures of the drawings shown below, making reference to an embodiment.

DETAILED DESCRIPTION

Figure 1:
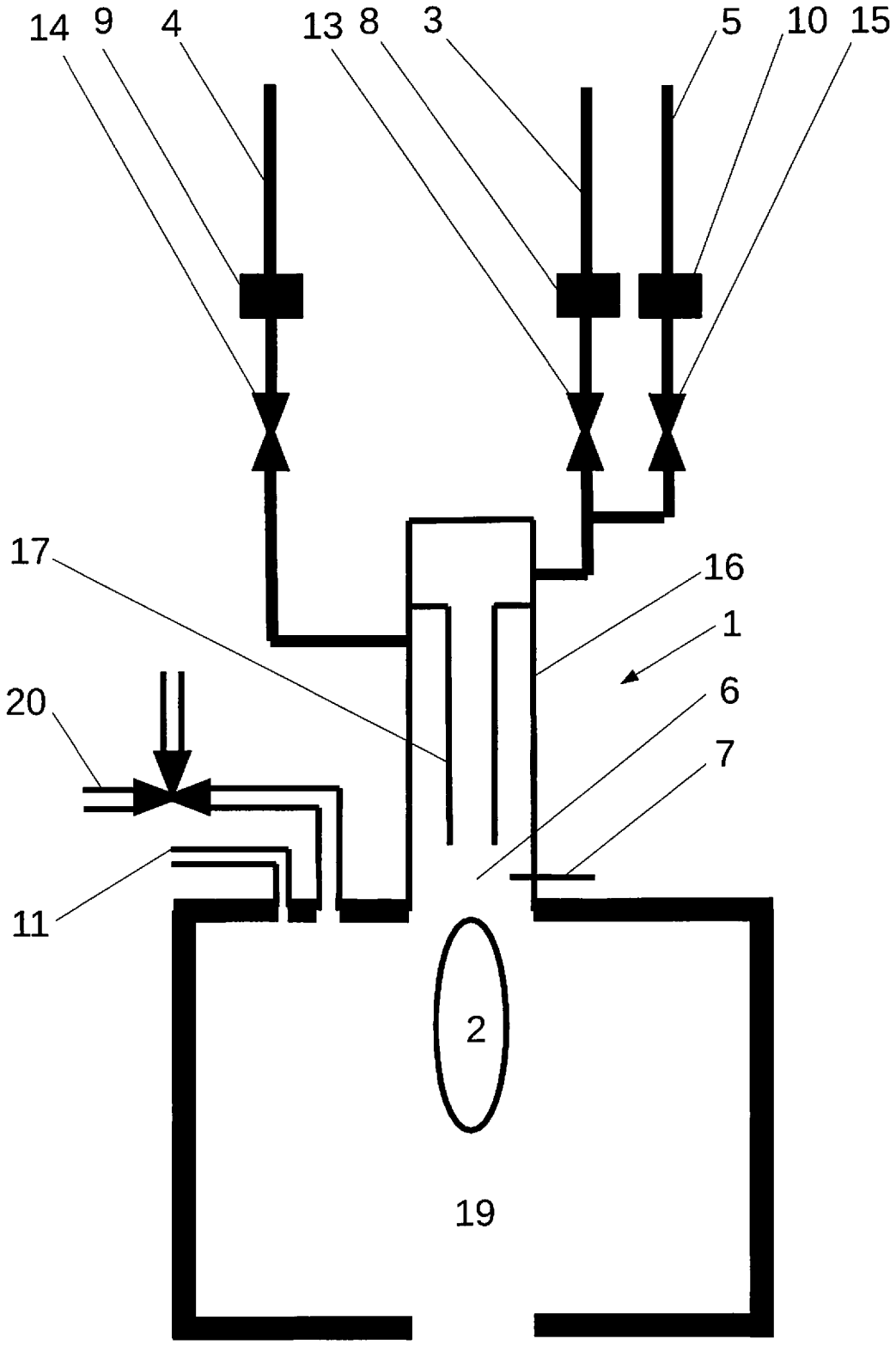
FIG. 1 a burner comprising feeds for oxygen, fuel gas and diluent gas, having a combustion chamber with a feeding means for industrial gas and with a feed line for reaction gas, FIG. 2 a waste-gas treatment device having a burner according to FIG. 1, and FIG. 3 a process installation with three processing chambers, each having a vacuum pump, a signal transmission unit and a waste-gas treatment device with a gas sensor.

FIG. 1 shows a burner 1 for generating a flame 2 in a combustion chamber 19 for burning pollutants in an industrial gas. The burner 1 has a feed line 3 for a fuel gas and a feed line 4 for oxygen, each to be fed into the combustion chamber 19 or into a premixing chamber 6 of the combustion chamber 19.

FIG. 1 also shows an ignition apparatus 7 for igniting the gas mixture present in the combustion chamber 19 or in the premixing chamber 6.

According to FIG. 1, the fuel gas and the oxygen are each fed into the premixing chamber 6 of the burner 1 in an essentially cylindrical pipe 16, 17. The cylindrical pipes 16, 17 are configured as an outer pipe 16 and an inner pipe 17 that are concentrical to each other, wherein the outer pipe 16 and the inner pipe 17 are arranged at a radial distance from each other. Depending on the application, the fuel gas can be conveyed in the outer pipe 16 or in the inner pipe 17, with the oxidant then being correspondingly conveyed in the outer pipe 16 or in the inner pipe 17.

Another feed line 5 is provided for admixing a diluent gas, preferably an inert gas, for instance, nitrogen, into the fuel gas. As can also be seen in FIG. 1, the additional feed line 5 for the diluent gas opens up in the feed line 3 for the fuel gas, Within the scope of the method according to the invention for the thermal disposal of pollutants in industrial gases, in order to generate a flame for burning the pollutants, a fuel gas and oxygen are introduced into a combustion chamber 19 of a burner 1, where they are then ignited. In order to reduce the calorific value of the gas mixture relative to the fuel gas, the diluent gas is fed in and the throughput of the diluent gas is regulated as a function of the composition of the industrial gas in order to adapt the gas mixture consisting of diluent gas and fuel gas.

For this purpose, the feed lines 3, 4, 5 each have a flow regulator (regulation means) 8, 9, 10 and/or a valve (blocking means) 13, 14, 15 for regulating and/or blocking the appertaining gas throughput. These flow regulators (regulation means) 8, 9, 10 can be actuated by a control unit 23.

In this manner, for purposes of a dynamic adaptation of the gas composition, the regulation means 10 associated with the additional feed line 5 is used to regulate the throughput of the diluent gas in the additional feed line 5 as a function of the composition of the industrial gas that is to be treated.

The diluent gas can be admixed to the fuel gas before being introduced into the combustion chamber 19.

The admixture of the diluent gas to the fuel gas can take place before the generation of a flame for burning the pollutants and/or before mixing the fuel gas with oxygen.

The method can especially be employed for diffusion burners wherein the fuel gas or the diluted fuel gas is fed into the combustion chamber 19 or into the pre-mixing chamber 6 separately from the oxygen, and both gas streams are only combined immediately prior to the reaction.

The diluent gas can be an inert gas. As a rule, nitrogen is available as inert gas. However, any other gas that does not form a reactive mixture with the fuel gas can also be used.

In particular, the volumes of oxygen and/or of fuel gas flowing into the combustion chamber 19 and/or the volumes of the diluent gas admixed to the fuel gas can be regulated separately.

It is conceivable for an additional oxidant such as, for instance, air or oxygen, to be introduced into the combustion chamber 19 in a regulated manner as a function of the chemical composition of the industrial gas.

The information about the composition of the industrial gas can be relayed via the control unit 23 to the flow regulators (regulation means) 8, 9, 10 for the gas throughput for the fuel gas, for the oxygen and/or for the diluent gas. As a function of this information, the fuel gas composition is dynamically adapted by regulating the gas throughput.

This information about the composition of the industrial gas can be ascertained from operating states of a process that has preceded the method for thermally disposing of pollutants in industrial gases. As already mentioned, for this purpose, information from upstream process installations is transmitted via the communication connection (30) to the control unit (23). The thus-resultant advantageous values for the fuel gas, for the oxygen and for the diluent gas are ascertained in the control unit (23) and set via the flow regulators (regulation means) (8, 9, 10).

According to the present embodiment, if the industrial gas contains tetrafluoromethane ($CF_4$), the inflow of diluent gas is reduced, especially all the way to below a value that is or can be prescribed. In this case, the inflow of the diluent gas amounts to a maximum of 1% of the volumetric flow of the fuel gas.

This regulation as a function of the industrial waste gas is explained in detail below.

In the present embodiment, the burner according to FIG. 1 is used in a waste-gas treatment device (A) 18.

Figure 2:
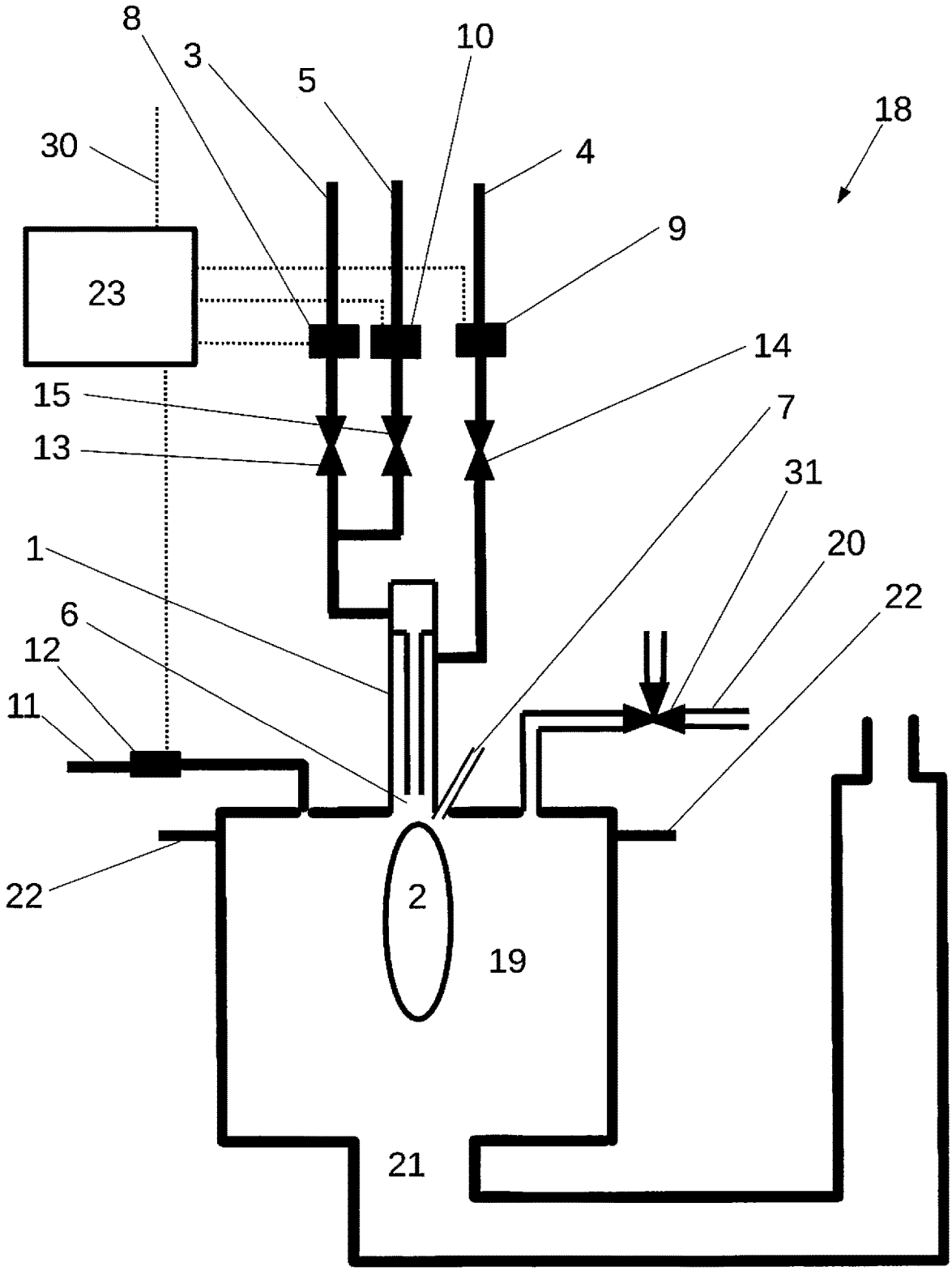

FIG. 2 depicts such a waste-gas treatment device (A) 18, having at least one burner 1 arranged in a combustion chamber 19, in order to generate a flame 2 for burning pollutants in an industrial gas.

The waste-gas treatment device (A) 18 has at least one feeding means 20 for the industrial gas and having at least one discharge means 21 for the thermally treated waste gases.

Moreover, the present embodiment provides for a feed line 11 for a reaction gas, especially an oxidant and/or a reducing agent, on the waste-gas treatment device 18. The inflow of reaction gas can be regulated by means of a flow regulator (regulation means) 12.

Moreover, the present embodiment provides for liquid feed lines 22, especially on the side wall of the combustion chamber 19.

The depiction according to FIG. 2 also shows the control unit 23 and the flow regulators (regulation means) 8, 9, 10 for regulating and/or controlling the throughput through the feed lines 3, 4, 5 for the fuel gas and/or for the oxygen and/or for the diluent gas. The valves (blocking means) 13, 14, 15 can also be seen there.

When it comes to a process for treating silicon wafers, the gases $CF_4$ (tetrafluoromethane), $SF_6$ (sulfur hexafluoride) and $NF_3$ (nitrogen trifluoride) among others, are employed in a process installation (T) 26, wherein said gases can be fed to the process via an industrial gas supply source 27. These gases can be used at the same time or else one after the other.

Figure 3:
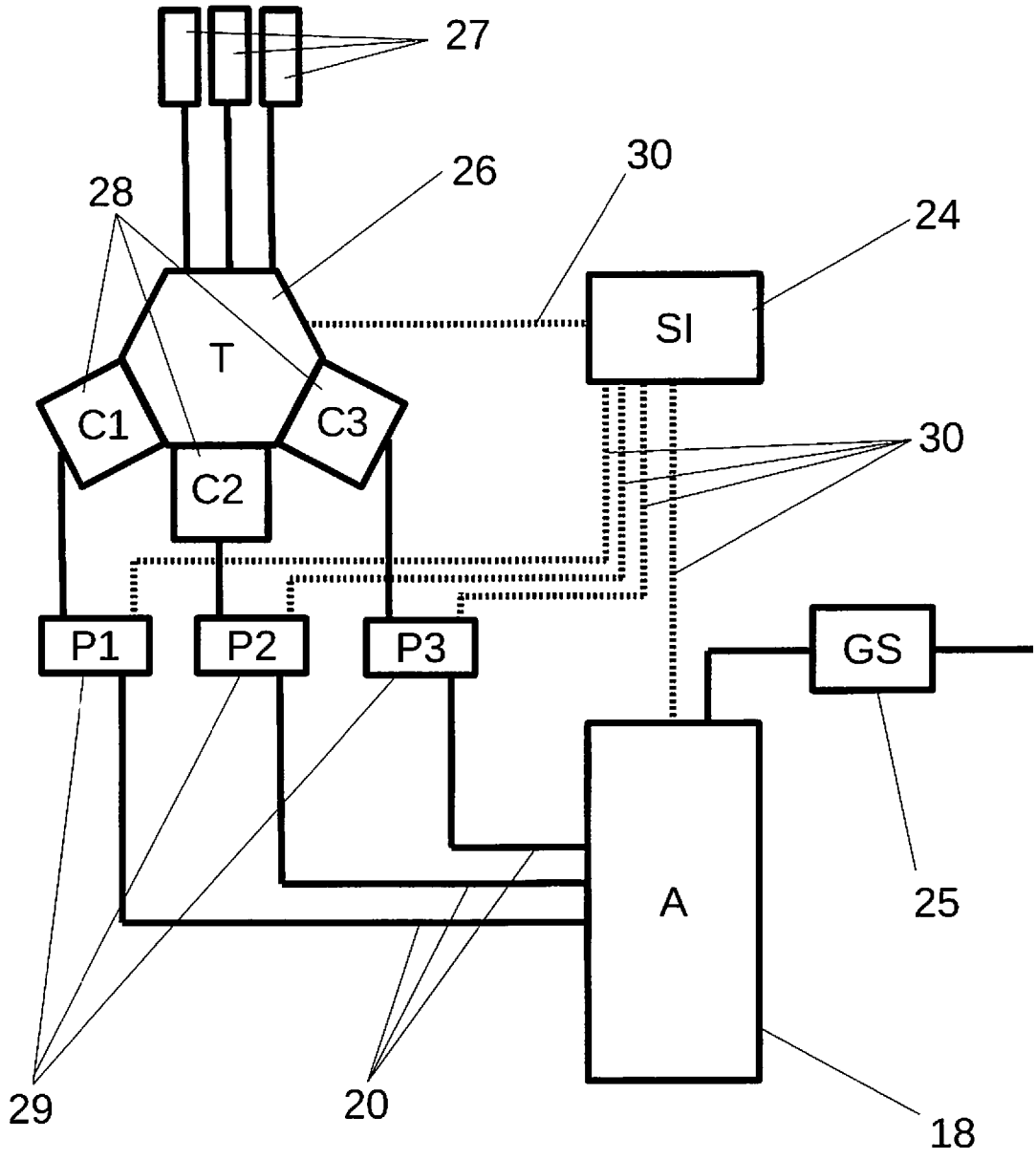

According to FIG. 3, the process installation (T) 26 has, for example, three processing chambers (C1, C2 and C3), each of which is designated by the reference numeral 28. The industrial waste gases are exhausted out of the processing chambers (C1, C2 and C3) 28 by means of vacuum pumps (P1, P2 and P3), designated by the reference numeral 29, and transported to the waste-gas treatment device (A) 18. For technical reasons, a permanent stream of nitrogen is fed into the vacuum pumps (P1, P2 and P3) 29, wherein the gases that are to be disposed of are present in diluted form in such a stream.

Signals SP1, SP2 and SP3 that indicate through which vacuum pump (P1, P2, P3) 29 the gas to be disposed of is flowing are transmitted by the process installation (T) 26 to the waste-gas treatment device (A) 18 via a signal transmission unit (SI) 24. The waste-gas treatment device (A) 18 has valves 31 via which, as a function of the signals SP1, SP2, SP3, the industrial waste gases can be deflected either into the combustion chamber 19 or else in untreated form into an exhaust-air line.

If the stream of nitrogen coming out of the vacuum pumps (P1, P2, P3) 29 has been non-adjustably set and is known, it is possible to ascertain on the basis of the signals SP1, SP2, SP3 the flow of nitrogen $FRN_2$ that is momentarily flowing in total into the burner 1. It is likewise possible for the vacuum pumps (P1, P2, P3) 29 to be connected to the signal transmission unit (S1) 24 and to transmit to them, in the form of a value, the momentary stream of nitrogen $FRN_2$ coming out of the pumps (P1, P2, P3) 29. The signal transmission unit (S1) 24 can then calculate the sum of all of the nitrogen streams and transmit them as a value $FRN_2$ to the waste-gas treatment device (A) 18 via the communication connection 30.

If none of the signals SP1, SP2, SP3 indicates industrial waste gas to be disposed of, the burner 1 can be set at a prescribed state entailing minimum consumption or else it can be switched off altogether.

By means of additional signals FCF4-1, FCF4-2 and FCF4-3 from the process installation (T) 26, it is communicated whether $CF_4$ is present in the industrial waste gas coming out of the processing chambers (C1, C2, C3) 28.

By means of additional signals FSF6-1, FSF6-2 and FSF6-3 from the process installation (T) 26, it is communicated whether $SF_6$ is present in the industrial waste gas coming out of the processing chambers (C1, C2, C3) 28.

The control unit 23 determines the requisite fuel gas stream FBG on the basis of the ascertained stream of nitrogen $FRN_2$ into the combustion chamber 19 and on the basis of the signals FCF4-1, FCF4-2, FCF4-3 and FSF6-1, FSF6-2 and FSF6-3. This can be done, for instance, through a calculation according to the formula $$FBG=a\times FRN_2+b,$$

wherein a and b stand for prescribed parameters that have been ascertained empirically.

The values of the parameter a and also of the parameter b depend on whether the industrial waste gas contains $CF_4$ or $SF_6$ or else neither of them.

A value A1 is selected for a if one of the signals FCF4-1, FCF4-2, FCF4-3 indicates the presence of $CF_4$. A value A2 is selected for a if none of the signals indicates the presence of $CF_4$ but one of the signals FSF6-1, FSF6-2, FSF6-3 indicates the presence of $SF_6$.

A factor A3 is selected if none of the signals indicates the presence of $CF_4$ or $SF_6$. In this context, the factor is A1>A2>A3. A similar logic can be employed for the parameter b.

If the industrial waste gas contains $CF_4$, this method causes more fuel gas to be used than if it contains $SF_6$ or only $NF_3$.

The stream of oxygen FBO through the burner 1 is calculated proportionally to the fuel gas stream FBG according to the formula $$FBO=c\times FBG+d,$$

wherein c and d stand for parameters that have been non-adjustably prescribed, or else, similarly to a and b, they can be selected from prescribed tables as a function of the signals for $CF_4$ and $SF_6$.

In applications where oxidizing or reducing pollutants are contained in the industrial gas, the stoichiometry of the burner can be influenced by selecting the parameters c and d as a function of the type and stream of the pollutants. For this purpose, additional signals can be defined and transmitted which indicate the presence of these substances and/or of their streams as well.

According to the invention, a regulatable stream of nitrogen FBN is admixed into the fuel gas upstream from the burner 1. This stream is calculated, for example, according to the formula $$FBN=e\times FBG+f,$$

wherein the parameters e and f are both selected to be 0 so that FBN=0 if one of the signals FCF4-1, FCF4-2, FCF4-3 indicates the presence of $CF_4$. Otherwise, fixed prescribed values can be used for e and f, or else values are selected that are dependent on the signals FSF6-1, FSF6-2, FSF6-3 and on the value $FRN_2$ stemming from empirically ascertained relationships.

These empirically ascertained relationships are selected in such a way that the harmful industrial gases contained in the industrial waste gas can still just about be destroyed with the requisite efficiency, for instance, to a level >95%, while at the same time, however, the formation of nitrogen oxide is minimal.

At those times when the burner 1 is completely switched off, it is advantageous to set a prescribed value for the nitrogen stream FBN to be >0 in order to ensure flushing of the burner, thus preventing the intrusion of dust or moisture.

For technical reasons, it might be also advantageous to not regulate the stream of nitrogen FBN into the fuel gas to exactly 0, but rather to retain a minimum flow of nitrogen FBN in order to flush the line, wherein the minimum flow is selected so low, for example, <0.5% of the fuel gas stream, that the properties of the flame are not impacted upon to any considerable degree.

Likewise feasible are methods with which signals stemming from the process installation (T) 26 or from the signal transmission unit (SI) 24 not only indicate the presence of certain industrial gases or of other gases added downstream from the process installation (T) 26, but also their streams. Such information allows a more precise adaptation of the burner 1 and of the reaction gases, and also other functions of the installation such as, for example, the regulation of a subsequent alkaline waste-gas scrubbing can be improved. Thus, for instance, the streams of combustible industrial gases or pollutants can be transmitted so that on this basis, the demand for additional oxidant can be calculated and its flow through the feed line 11 for the reaction gas can be regulated. The precise adaptation of the reaction gases to the momentary industrial gas streams in the processing installation makes it possible to minimize the formation of nitrogen oxides and carbon monoxide. The regulation of the gas streams to the minimally required flows for disposing of the pollutants also makes it possible to minimize energy consumption.

Gas sensors (GS) 25 for the purified gas downstream from the waste-gas treatment device (A) 18 can serve to monitor, for instance, the concentration of carbon monoxide or nitrogen oxides in order to ensure that the regulation of the gas throughput through the burner 1 and the regulation of the reaction gases attain the desired effect of a complete combustion as well as low nitrogen oxide emissions. Gas sensors (GS) 25 can also be deployed for continuously detecting highly harmful substances in the purified gas in order to ensure that the waste-gas treatment device (A) 18 disposes of these pollutants to a sufficient degree in all operating states.

LIST OF REFERENCE NUMERALS

1 burner
2 flame
3 feed line for the fuel gas
4 feed line for the oxygen
5 additional feed line for the diluent gas
6 premixing chamber
7 ignition apparatus
8 regulation means for the fuel gas
9 regulation means for the oxygen
10 regulation means for the inert gas
11 feed line for the for the reaction gas
12 regulation means for the reaction gas
13 blocking means for the fuel gas
14 blocking means for the oxygen
15 blocking means for the inert gas
16 outer pipe
17 inner pipe
18 waste-gas treatment device (A)
19 combustion chamber
20 feeding means for the industrial gas
21 discharge means for the waste gases
22 liquid feed lines
23 control unit
24 signal transmission unit (SI)
25 gas sensor (GS)
26 process installation (T)
27 industrial gas supply source
28 processing chamber (C1, C2, C3)
29 vacuum pump (P1, P2, P3)
30 communication connection
31 valve
$FRN_2$ nitrogen stream
FBG fuel gas stream
FBO oxygen stream
FBN additional nitrogen stream
SP1 signals stemming from the process installation
SP2 signals stemming from the process installation
SP3 signals stemming from the process installation
$FCF_4$-1 signals stemming from the process installation T
$FCF_4$-2 signals stemming from the process installation T
$FCF_4$-3 signals stemming from the process installation T
FSF6-1 signals stemming from the process installation T
FSF6-2 signals stemming from the process installation T
FSF6-3 signals stemming from the process installation T
a, b, c parameters
d, e, f, parameters
A1, A2 values
A3 value

The invention claimed is:

1. A method for the thermal disposal of perfluorinated compounds in an industrial gas, comprising:

feeding the industrial gas into a combustion chamber (19) of a burner (1); admixing a diluent gas with a fuel gas;

then feeding the fuel gas admixed with diluent gas into the combustion chamber (19) of the burner (1) via a feed line separate from the industrial gas, wherein the diluent gas is introduced into the combustion chamber (19) in order to reduce the calorific value of the gas mixture consisting of diluent gas and fuel gas relative to the calorific value of the fuel gas;

regulating throughput of the diluent gas as a function of the composition of the industrial gas in order to adapt the gas mixture consisting of diluent gas and fuel gas so that the feed of the diluent gas is reduced when the industrial gas contains perfluorinated compounds, wherein if the industrial gas contains tetrafluoromethane (CF4), the feed of the diluent gas is substantially discontinued or entirely discontinued; and feeding oxygen into the combustion chamber (19) of the burner (1); and then igniting the fuel gas and oxygen in order to generate a flame for burning the perfluorinated compounds, wherein the admixture of the diluent gas with the fuel gas takes place before a flame is generated for burning the perfluorinated compounds and before the fuel gas is mixed with the oxygen.

2. The method according to claim 1, wherein the diluent gas is an inert gas.

3. The method according to claim 1, wherein volumes of the fuel gas, the oxygen and the diluent gas or volumes of the oxygen and an admixture of diluent gas and fuel gas flowing into the combustion chamber (19) are separately regulated.

4. The method according to claim 1 wherein volume(s) introduced into the combustion chamber of one or more of the fuel gas, the oxygen and/or the diluent gas, is/are dynamically regulated based on throughput and composition of the industrial gas introduced into the combustion chamber.

5. The method according to claim 4, wherein composition of the industrial gas is ascertained from operating states of a process that generated the industrial gas.

6. The method according to claim 1, wherein, if the industrial gas contains tetrafluoromethane (CF4), diluent gas is fed at an amount of 1% or less of the volumetric flow of the fuel gas.

7. The method according to claim 1, further comprising feeding an additional oxidant such as air or oxygen a regulated manner into the combustion chamber (19) as a function of the chemical composition of the industrial gas.

8. A burner (1) for generating a flame (2) in a combustion chamber (19) for burning perfluorinated compounds in an industrial gas, comprising:

a feed line (3) for a fuel gas to be fed into the combustion chamber (19);

a feed line (4) for oxygen to be fed into the combustion chamber (19);

a feed line (20) for the industrial gas to be fed into the combustion chamber (19);

an ignition apparatus (7) for igniting the gas mixture present in the combustion chamber (19);

another feed line (5) for admixing a diluent gas into the fuel gas before the fuel gas and the diluent gas are introduced into the combustion chamber (19), wherein the additional feed line (5) for the diluent gas opens up in the feed line (3) for the fuel gas, and wherein the feed line (3) and the additional feed line (5) are separate from the feed line (20) for the industrial gas; and a process installation (26) that communicates the presence of perfluorinated compounds in the industrial gas prior to introduction into the combustion chamber (19), wherein the feed of the diluent gas is reduced, substantially discontinued or entirely discontinued when the industrial gas contains perfluorinated compounds.

9. The burner (1) according to claim 8, further comprising a flow regulator (10) associated with the additional feed line (5).

10. The burner (1) according to claim 8, wherein the feed lines (3, 4, 5) each have a flow regulator (8, 9, 10) and/or a valve (13, 14, 15) for regulating and/or blocking gas throughput.

11. A waste-gas treatment device (18), comprising:

at least one burner (1) arranged in a combustion chamber (19), for generating a flame (2) to burn perfluorinated compounds in an industrial gas according to claim 8;

at least one feeding means (20) for feeding the industrial gas into the combustion chamber; and at least one discharge means (21) for discharging thermally treated waste gases from the combustion chamber.

12. The waste-gas treatment device (18) according to claim 11, further comprising at least one feed line (11) for a reaction gas selected from the group consisting of: an oxidant, a reducing agent, and a mixture of oxidant(s) and reducing agent(s).

13. The waste-gas treatment device (18) according to claim 11, further comprising liquid feed lines (22) on the side wall of the combustion chamber (19).

14. The waste-gas treatment device (18) according to claim 11, further comprising flow regulators (8, 9, 10) connected to a control unit (23) that serves to control the flow regulators (8, 9, 10).

15. A method for burning off perfluorinated compounds entrained in an industrial gas, comprising:

feeding the industrial gas into a combustion chamber of a burner;

mixing a diluent gas with a fuel gas to form a gas mixture, wherein said diluent gas reduces calorific value of the gas mixture relative to the calorific value of the fuel gas alone, and wherein throughput of the diluent gas as a function of the composition of the industrial gas is regulated in order to adapt the diluent gas and fuel gas mixture to a predetermined calorific value to burn off the perfluorinated compounds in the industrial gas so that the feed of the diluent gas is reduced when the industrial gas contains perfluorinated compounds, wherein if the industrial gas contains tetrafluoromethane (CF4), the feed of the diluent gas is discontinued;

feeding the diluent gas and fuel gas mixture via a feed line separate from the industrial gas into the combustion chamber;

separately feeding oxygen into the combustion chamber; and then igniting the fuel gas in order to generate a flame for burning off the perfluorinated compounds of the industrial gas in the combustion chamber.

16. The method according to claim 1, wherein the diluent gas is nitrogen.

* * * * *